US009249637B2

(12) United States Patent
Springett et al.

(10) Patent No.: US 9,249,637 B2
(45) Date of Patent: Feb. 2, 2016

(54) DUAL GRADIENT DRILLING SYSTEM

(71) Applicant: National Oilwell Varco, L.P., Houston, TX (US)

(72) Inventors: Frank B. Springett, Spring, TX (US); Svein Ove Aanesland, Høllen I Søgne (NO); Geoffrey Alexander Pickett, Sugar Land, TX (US)

(73) Assignee: National Oilwell Varco, L.P., Houston, TX (US)

( * ) Notice: Subject to any disclaimer, the term of this patent is extended or adjusted under 35 U.S.C. 154(b) by 77 days.

(21) Appl. No.: 14/054,235

(22) Filed: Oct. 15, 2013

(65) Prior Publication Data

US 2014/0102789 A1 Apr. 17, 2014

Related U.S. Application Data

(60) Provisional application No. 61/713,972, filed on Oct. 15, 2012.

(51) Int. Cl.
*E21B 7/12* (2006.01)
*E21B 21/00* (2006.01)
*E21B 21/08* (2006.01)

(52) U.S. Cl.
CPC ..... *E21B 21/001* (2013.01); *E21B 7/12* (2013.01); *E21B 21/08* (2013.01)

(58) Field of Classification Search
CPC ..... E21B 7/12; E21B 21/001
USPC ..... 166/358; 175/5, 207, 217
See application file for complete search history.

(56) References Cited

U.S. PATENT DOCUMENTS

| | | | | |
|---|---|---|---|---|
| 4,813,495 | A * | 3/1989 | Leach | 175/6 |
| 6,263,981 | B1 * | 7/2001 | Gonzalez | 175/5 |
| 6,530,437 | B2 * | 3/2003 | Maurer et al. | 175/5 |
| 6,702,025 | B2 * | 3/2004 | Meaders | 166/335 |
| 6,814,142 | B2 * | 11/2004 | Paulk et al. | 166/250.07 |
| 6,854,533 | B2 * | 2/2005 | Galloway et al. | 175/22 |
| 6,926,101 | B2 * | 8/2005 | deBoer | 175/70 |

(Continued)

FOREIGN PATENT DOCUMENTS

| | | |
|---|---|---|
| EP | 0290250 | 11/1988 |
| WO | 2011071586 | 6/2011 |

OTHER PUBLICATIONS

International Search Report and Written Opinion dated Sep. 3, 2014 for corresponding International Application No. PCT/US2013/065021 (13 pgs.).

(Continued)

*Primary Examiner* — Matthew Buck
*Assistant Examiner* — Aaron Lembo
(74) *Attorney, Agent, or Firm* — Derek V. Forinash; Porter Hedges LLP

(57) ABSTRACT

A dual gradient drilling system comprises a primary riser that is coupled to a drilling rig and a subsea wellhead and an auxiliary riser that is coupled to the drilling rig and to the primary riser by a fluid conduit that is disposed at a point between the drilling rig and the wellhead. The fluid conduit provides fluid communication between the primary riser and the auxiliary riser. A pump system is disposed within the auxiliary riser and is in fluid communication with the fluid conduit. A drive string is disposed within the auxiliary riser and is coupled to the pump system so as to operably couple the pump system to the drilling rig.

20 Claims, 8 Drawing Sheets

(56) References Cited

U.S. PATENT DOCUMENTS

| | | | | |
|---|---|---|---|---|
| 7,866,399 | B2 * | 1/2011 | Kozicz et al. | 166/367 |
| 7,913,764 | B2 | 3/2011 | Smith et al. | |
| 7,938,190 | B2 | 5/2011 | Talamo et al. | |
| 7,987,908 | B2 * | 8/2011 | Colley, III | 166/263 |
| 8,157,014 | B2 | 4/2012 | Hariharan et al. | |
| 8,162,063 | B2 | 4/2012 | Humphreys | |
| 8,176,985 | B2 * | 5/2012 | Humphreys | 166/358 |
| 8,322,439 | B2 * | 12/2012 | Fossli | 166/367 |
| 8,322,460 | B2 * | 12/2012 | Horton et al. | 175/5 |
| 8,342,249 | B2 * | 1/2013 | Payne | 166/358 |
| 8,387,705 | B2 * | 3/2013 | Heironimus | 166/358 |
| 8,517,111 | B2 * | 8/2013 | Mix et al. | 166/363 |
| 8,631,874 | B2 * | 1/2014 | Kozicz et al. | 166/367 |
| 8,640,778 | B2 * | 2/2014 | Fossli | 166/367 |
| 8,783,379 | B2 * | 7/2014 | Stave | 175/5 |
| 8,789,609 | B2 * | 7/2014 | Smith et al. | 166/372 |
| 8,807,223 | B2 * | 8/2014 | Smith | 166/335 |
| 8,881,831 | B2 * | 11/2014 | Orbell et al. | 166/367 |
| 8,881,843 | B2 * | 11/2014 | Todd et al. | 175/5 |
| 8,887,814 | B2 * | 11/2014 | Orbell et al. | 166/367 |
| 2002/0153141 | A1 * | 10/2002 | Hartman et al. | 166/302 |
| 2003/0070840 | A1 * | 4/2003 | Boer | 175/5 |
| 2004/0065440 | A1 * | 4/2004 | Farabee et al. | 166/358 |
| 2004/0084213 | A1 * | 5/2004 | DeBoer | 175/5 |
| 2006/0191716 | A1 * | 8/2006 | Humphreys | 175/5 |
| 2008/0296062 | A1 | 12/2008 | Horton, III et al. | |
| 2009/0223665 | A1 | 9/2009 | Colley, III | |
| 2009/0236144 | A1 | 9/2009 | Todd et al. | |
| 2010/0006297 | A1 * | 1/2010 | Stave | 166/335 |
| 2011/0209876 | A1 | 9/2011 | Reed | |
| 2011/0247831 | A1 | 10/2011 | Smith et al. | |
| 2011/0297388 | A1 * | 12/2011 | Stave | 166/345 |
| 2012/0080186 | A1 | 4/2012 | Reed | |
| 2012/0227978 | A1 * | 9/2012 | Fossli et al. | 166/363 |
| 2012/0234551 | A1 * | 9/2012 | Keller et al. | 166/347 |
| 2012/0273218 | A1 * | 11/2012 | Orbell et al. | 166/358 |
| 2013/0206423 | A1 * | 8/2013 | Weinstock et al. | 166/358 |
| 2014/0224487 | A1 * | 8/2014 | Budde et al. | 166/285 |

OTHER PUBLICATIONS

Jerome J Schubert et al: "Dual Gradient Drilling Basic Technology," Lesson 2 Key Success Factors in DGD; pp. 3-7, 22; dated Jun. 11, 2000 (39 pgs.).

Roger Stave, "Implementation of Dual Gradient Drilling Impact on Well Construction", SPE Bergen One Day Seminar 2012, dated Mar. 19, 2012 (30 pgs.).

International Preliminary Report on Patentability dated Feb. 26, 2015 for International Application No. PCT/US2013/065021 (9 pgs.).

* cited by examiner

DUAL GRADIENT DRILLING SYSTEM

CROSS-REFERENCE TO RELATED APPLICATIONS

This application claims priority to U.S. patent application Ser. No. 61/713,972, titled Dual Gradient Drilling System, which was filed Oct. 15, 2012. This priority application is hereby incorporated by reference in its entirety into the present application, to the extent that it is not inconsistent with the present application.

BACKGROUND

This disclosure relates generally to methods and apparatus for drilling offshore oil and gas wells. More specifically, this disclosure relates to methods and apparatus for supporting dual gradient drilling operations. Still more specifically, this disclosure relates to methods and apparatus to remove drilling fluids from a riser so as to reduce bottom hole pressure in a wellbore.

Offshore drilling rigs utilize drilling risers as the conduit between the drilling equipment at the surface and drilling equipment mounted on the seafloor. The drilling riser is a tubular conduit that serves as an extension of the wellbore from the equipment on the wellhead at the seafloor to the floating drilling rig. Conventional drilling risers include a primary tubular conduit and a plurality of smaller, higher pressure auxiliary conduits that are externally mounted to the primary tubular and provide conduits for choke, kill, and auxiliary fluid communication with the subsea blowout preventers.

The drilling string is inserted through the riser and into the wellbore. Drilling fluid is pumped into the wellbore through the drill string and returns to the drilling rig via the riser. The drilling fluid serves to lubricate and cool the drill string and carries cuttings from the formation out of the wellbore. The column of drilling fluid contained in the wellbore and the riser creates a hydrostatic pressure within the wellbore that serves as the primary barrier to the influx of wellbore fluids into the wellbore.

The hydrostatic pressure within the wellbore must be kept within a specific range of pressures. If the hydrostatic pressure is too low, formation fluids can enter the wellbore and cause a blow out of the well. If hydrostatic pressure is too high, the rate of penetration of the drill string can be negatively impacted and/or the drilling fluids could cause fractures in the formation. In conventional drilling operations, hydrostatic pressure is regulated by controlling the density of the drilling fluid.

In certain offshore drilling applications, the water depth in which the well is located and the depth of the well being drilled may require a significant height of the column of drilling fluid. As the height of the column of drilling fluid increases, management of pressure within the wellbore by regulating drilling fluid density can become very difficult and limit the fluids that can be used for drilling. Dual gradient drilling operations have been developed to address these types of situations.

Dual gradient drilling operations seek to remove, or reduce the density of, a portion of the column of drilling fluid. This is often accomplished by removing a portion of the drilling fluid from the riser, or injecting a low density fluid into the riser, at a location between the wellhead and the drilling rig. This has the effect of decreasing the height of the column of drilling fluid, thus reducing the hydrostatic pressure acting on the wellbore and allowing higher density drilling fluids to be used in the well.

One problem facing dual gradient drilling systems is the additional equipment necessary to handle the drilling fluid and interface with both the riser and the drilling rig. Many dual gradient drilling systems rely on subsea pumps and other subsea fluid handling equipment. Providing power and control inputs to subsea equipment adds to the complexity of the system and the increases demands on the rig-based equipment and control systems. Many existing rigs are unable to support dual gradient drilling activities without major refit and/or addition of extra equipment.

Thus, there is a continuing need in the art for methods and apparatus for supporting dual gradient drilling operations with existing, or easily added, rig equipment that overcome these and other limitations of the prior art.

BRIEF SUMMARY OF THE DISCLOSURE

A dual gradient drilling system comprises a primary riser that is coupled to a drilling rig and a subsea wellhead and an auxiliary riser that is coupled to the drilling rig and to the primary riser by a fluid conduit that is disposed at a point between the drilling rig and the wellhead. The fluid conduit provides fluid communication between the primary riser and the auxiliary riser. A pump system is disposed within the auxiliary riser and is in fluid communication with the fluid conduit. A drive string is disposed within the auxiliary riser and is coupled to the pump system so as to operably couple the pump system to the drilling rig.

In some embodiments, the drive string is rotatably coupled to the pump system so that rotation of the drive string operates the pump system. In some embodiments, the drive string is rotated by a top drive mounted on the drilling rig. In some embodiments, the drive string provides a conduit for the supply of a pressurized working fluid from the drilling rig to a fluid motor of the pump system. In some embodiments, the pump system returns a drilling fluid from the primary riser to the drilling rig through the auxiliary riser. In some embodiments, the pump system returns a drilling fluid from the primary riser to the drilling rig through an auxiliary return line. In some embodiments, the pump system returns a drilling fluid from the primary riser to the drilling rig through a concentric riser that is disposed within the primary riser. In some embodiments, the system further comprises a linkage that is coupled to the primary riser and the auxiliary riser to maintain an axial offset between the primary riser and the auxiliary riser.

In certain embodiments, a dual gradient drilling system comprises a primary riser providing fluid communication between a drilling rig and a subsea wellbore; an auxiliary riser providing fluid communication between the drilling rig and the primary riser at a depth between the drilling rig and the subsea wellbore; and a pump system disposed within the auxiliary riser and operably coupled to the drilling rig by a drive string, wherein the pump system is operable to remove drilling fluid from the primary riser.

In some embodiments, the drive string is rotatably coupled to the pump system so that rotation of the drive string operates the pump system. In some embodiments, the drive string provides a conduit for the supply of a pressurized working fluid from the drilling rig to a fluid motor of the pump system. In some embodiments, the pump system returns a drilling fluid from the primary riser to the drilling rig through the auxiliary riser. In some embodiments, the pump system returns a drilling fluid from the primary riser to the drilling rig through an auxiliary return line. In some embodiments, the pump system returns a drilling fluid from the primary riser to the drilling rig through a concentric riser that is disposed within the primary riser. In some embodiments, the dual gradient drilling system further comprises a linkage that is coupled to the primary riser and the auxiliary riser to maintain an axial offset between the primary riser and the auxiliary riser.

In certain embodiments, a method comprises coupling a primary riser to a drilling rig and a subsea wellhead; coupling an auxiliary riser to the drilling rig; coupling the auxiliary riser to the primary riser at a location between the drilling rig and the subsea wellhead with a fluid conduit; coupling a pump system to the auxiliary riser and to the fluid conduit; and operating the pump system to remove a drilling fluid from the primary riser through the fluid conduit and into the pump system.

In some embodiments, the method further comprises pumping the drilling fluid from the pump system to the drilling rig through the auxiliary riser. In some embodiments, the method further comprises pumping the drilling fluid from the pump system to the drilling rig through a concentric riser that is disposed within the primary riser. In some embodiments, the pump system is operated by rotating a drive string that is coupled to the pump system and to the drilling rig, wherein the drive string is disposed within the auxiliary riser. In some embodiments, the pump system is operated by pumping a working fluid through a drive string that is coupled to the pump system and to the drilling rig, wherein the drive string is disposed within the auxiliary riser.

BRIEF DESCRIPTION OF THE DRAWINGS

For a more detailed description of the embodiments of the present disclosure, reference will now be made to the accompanying drawings, wherein.

DETAILED DESCRIPTION

Figure 1:
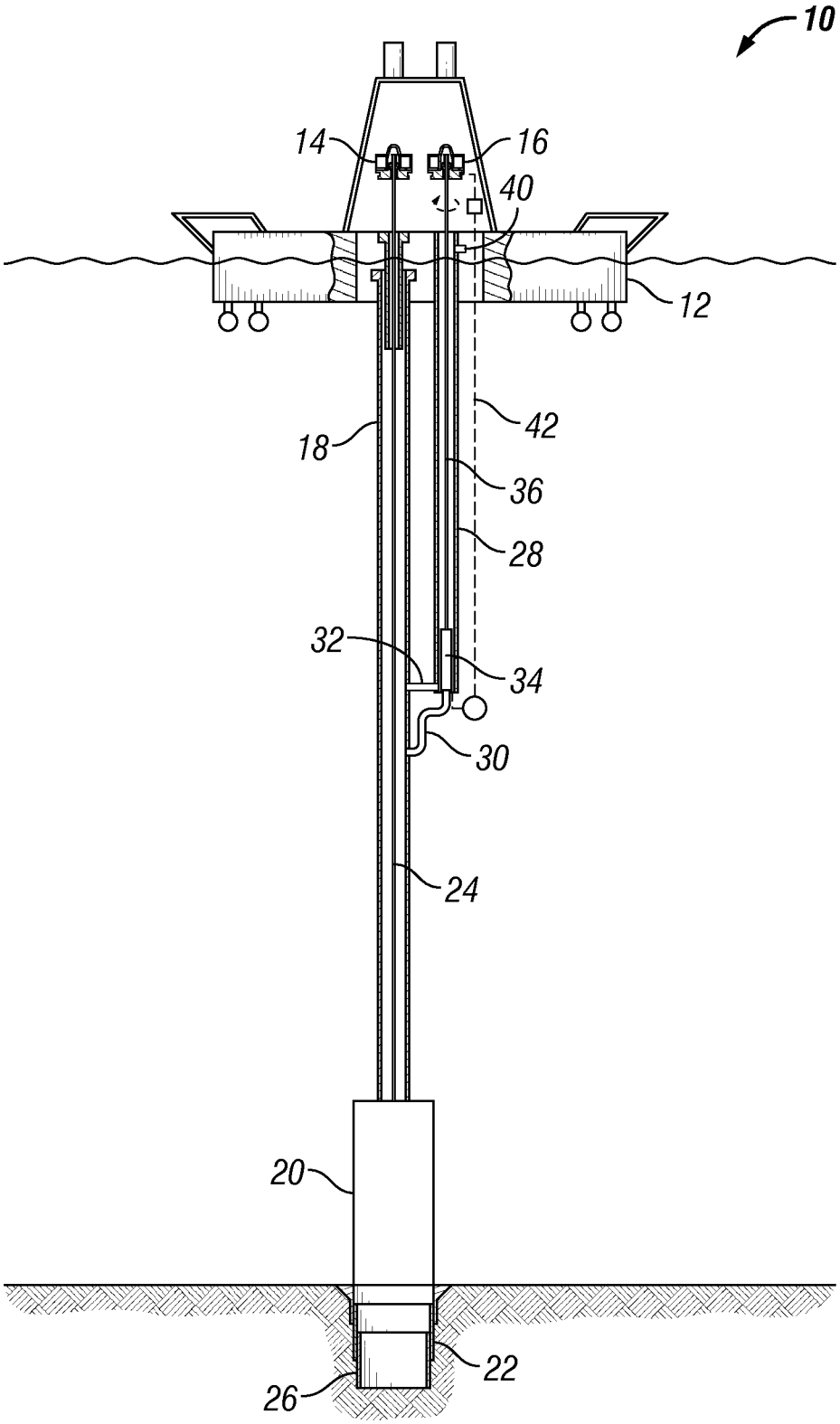
FIG. 1 is a partial schematic view of a dual gradient drilling system utilizing primary and auxiliary riser string.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

Referring initially to FIG. 1, a dual gradient drilling system 10 is operated by a dual activity drilling rig 12 having a primary hoist/top drive system 14 and an auxiliary hoist/top drive system 16. A primary drilling riser 18 is suspended from the drilling rig 12 and couples to a blowout preventer 20 mounted to a wellhead 22. A drill string 24 is disposed within the riser 18 and extends into a subsea wellbore 26 extending from the wellhead 22. Mud pumps located on the drilling rig 12 pump drilling fluid through the drill string 24 and into the wellbore 26. The primary hoist/top drive system 14 rotates and vertically moves the drill string 24. In conventional operations, the drilling fluid is returned to the drilling rig 12 through the primary riser 18. At the top of the primary riser 18, a diverter routes the returning drilling fluid to the rig's mud processing equipment where it is cleaned before being recirculated through the well.

Figure 2:
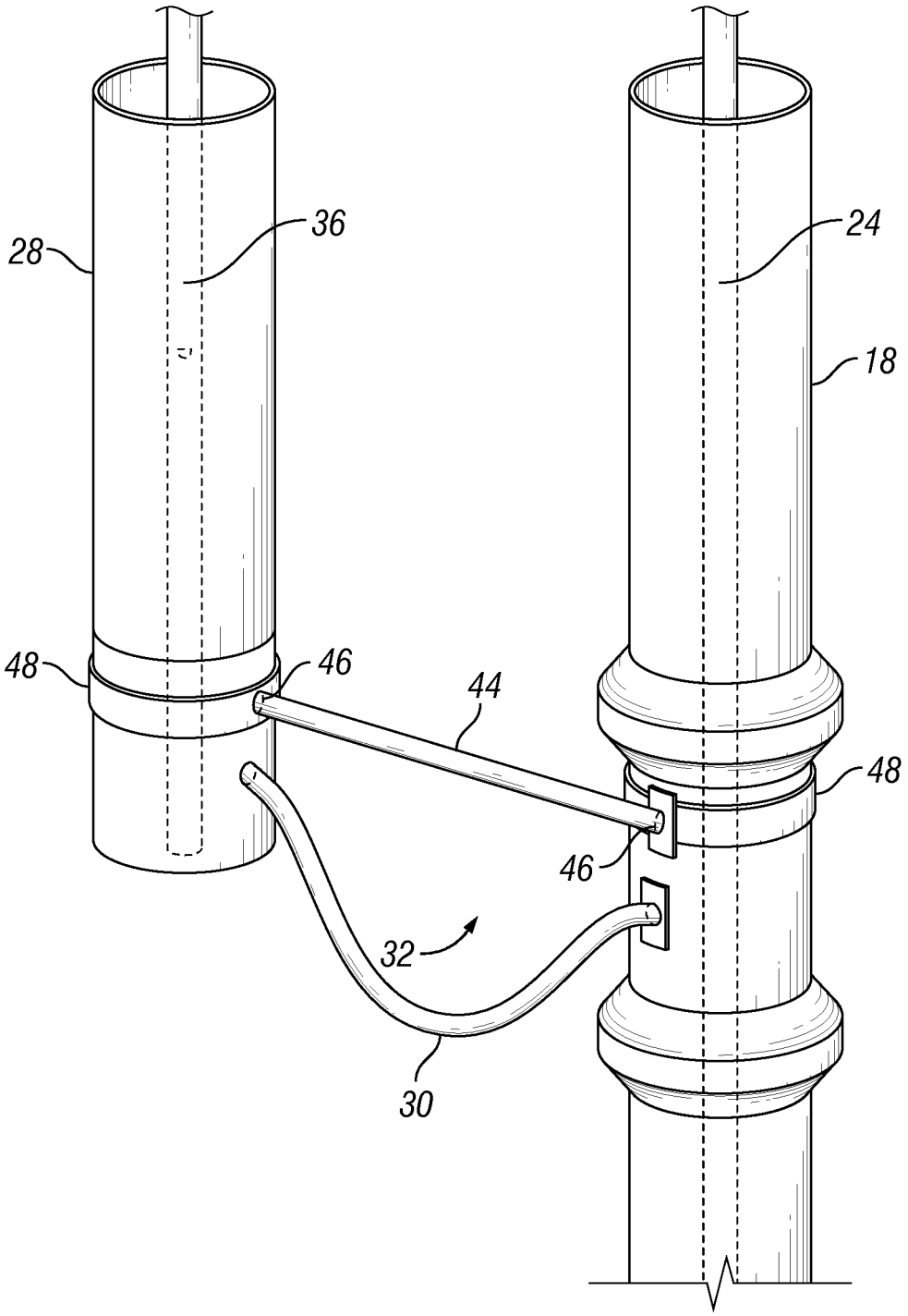
FIG. 2 is a partial schematic view of the connection between the primary riser and the auxiliary riser of a dual gradient drilling system.

Dual gradient drilling operations are supported by an auxiliary riser 28 that is suspended from the drilling rig 12 below the auxiliary hoist/top drive system 16. The auxiliary riser 28 is coupled to the primary riser 18 via a fluid conduit 30 and an offset linkage 32, which are shown in further detail in FIG. 2. Using the auxiliary hoist/top drive system 16, the auxiliary riser 28 can be installed separately from the primary riser 18 when needed for dual gradient drilling operations. Once the auxiliary riser 18 is installed, a pump system 34 can be run into the auxiliary riser on a drive string 36 that operably couples the pump system 34 to the drilling rig 12.

The auxiliary riser 28 provides a housing for a pump system 34 and a conduit for the connection of the drive string 36 to the drilling rig 12. The upper end of the auxiliary riser 28 may have a fluid outlet 40 that connects the auxiliary riser 28 to the mud processing equipment found on the drilling rig 12. A control line 42 can couple the drilling rig 12 to the fluid conduit 30 so as to provide a system for sensing the level of the drilling fluid in the primary riser 18 and selectively opening a valve that controls flow through the fluid conduit 30 into the auxiliary riser 28.

In certain embodiments, the offset linkage 32 may include a substantially rigid member 44. Each end of the rigid member 44 is coupled to a riser-mounted sleeve 48 by a pin connection 46. The riser-mounted sleeves 48 may be longitudinally constrained on the riser strings (18, 28) but allowed to rotate freely relative to the risers. One, or both, of the pin connections 46 can be connected and disconnected subsea to allow the two riser strings 18, 28 to be run or recovered independently. The combination of the pin connections 46 and the riser-mounted sleeves 48 allow the two riser strings 18, 28 to move independently in response to currents, waves, and other forces. The rigid member 44 maintains a substantially fixed axial offset distance between the primary riser 18 and the auxiliary riser 28 so that the connections between the riser strings and the fluid conduit 30 are not subject to severe loads from movement of the riser strings.

In operation, the rigid member 44 may be coupled to one of the riser strings 18, 28 in a storage position during running of the riser. Once the riser is in position, the rigid member 44 can be pivoted about one of the pin connections 46 and coupled to the other riser string via the other pin connection. Once the two riser strings 18, 28 are connected by the rigid member, the fluid conduit 30 can be run between the two riser strings. In certain embodiments, the fluid conduit 30 may be a flexible hose or pipe having at least one end connection that allows for subsea coupling of the conduit to one, or both, of the riser strings 18, 28. The fluid conduit 30 may also be fitted with a valve for controlling the flow of fluid through the conduit.

Figure 3:
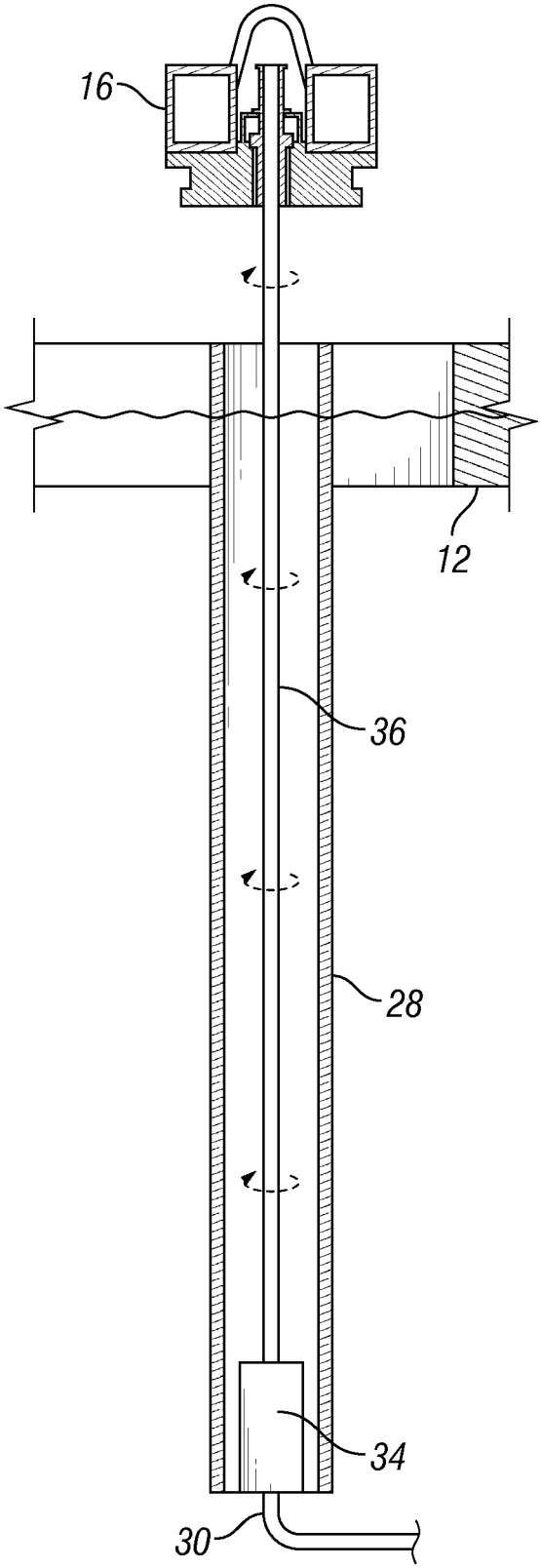
FIG. 3 is a partial schematic view of mud return pump being powered by an auxiliary top drive.
Figure 4:
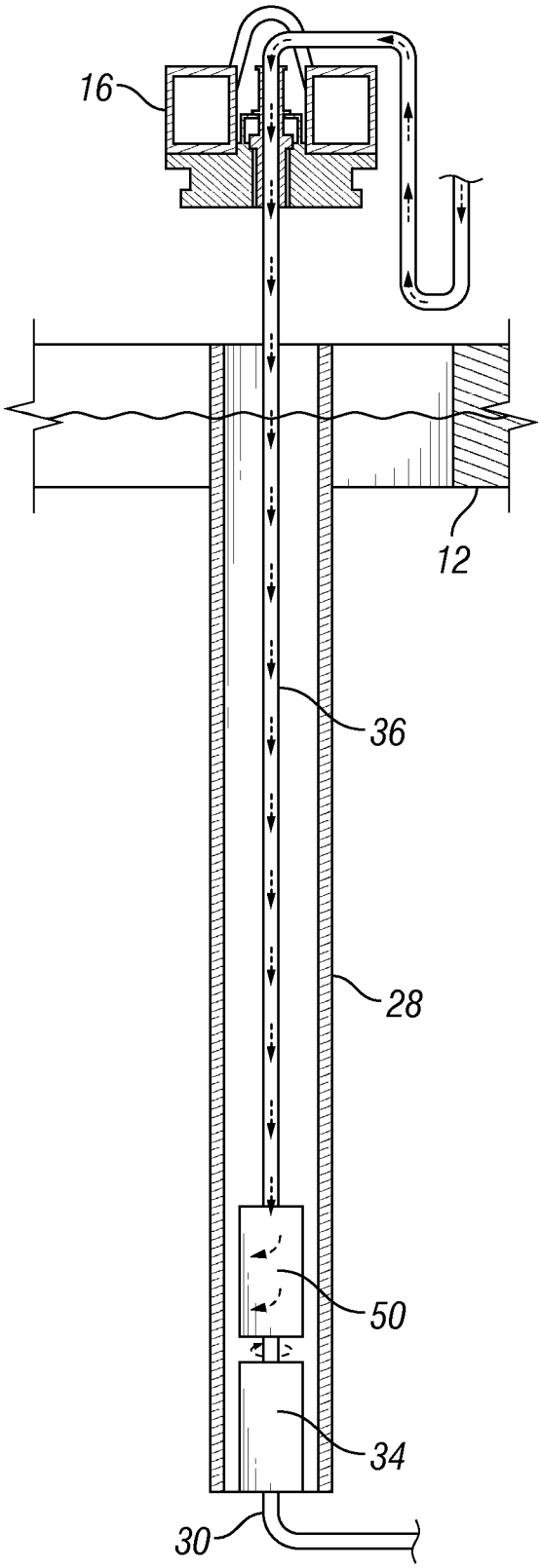
FIG. 4 is a partial schematic view of mud return pump being powered by a fluid motor.
Figure 5:
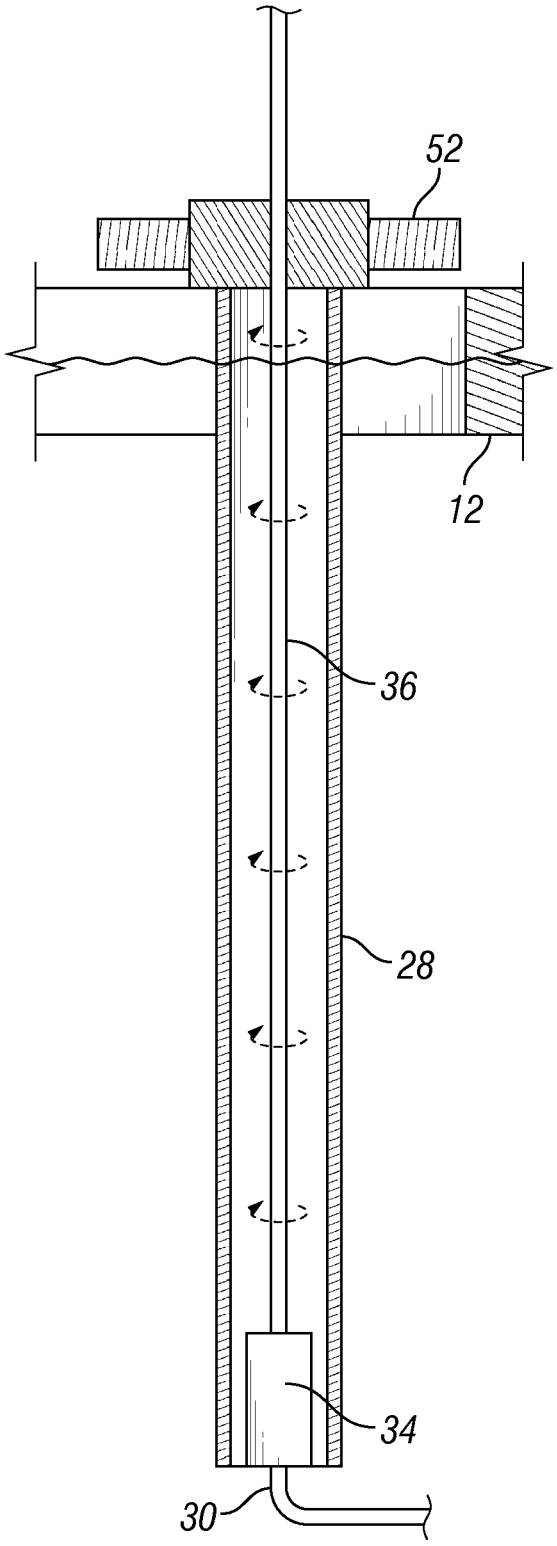
FIG. 5 is a partial schematic view of mud return pump being powered by a drill floor mounted drive system.

FIGS. 3-5 illustrate different embodiments of systems used to power the pump system 34 disposed in the auxiliary riser 28. In each illustrated embodiment, the pump system 34 is powered from either existing equipment on the drilling rig 12 or by additional equipment that can be easily added to the drilling rig. Pump system 34 may include any pump driven by rotational motion. For example, pump system 34 may include a centrifugal pump, a rotary vane pump, a positive displacement pump, progressive cavity pump, or any other type of rotatory-driven pump. Pump system 34 may also include other rotary-driven fluid processing equipment, such as a macerator or grinder, which may be integral to the pump or a separate component of the pump system.

Referring now to FIG. 3, pump system 34 is rotatably coupled to the drilling rig 12 via a drive string 36 that is coupled to the auxiliary top drive 16. The top drive 16 rotates the drive string 36 so that rotation of the drive string 36 operates the pump system 34. In FIG. 4, the drive string 36 is coupled to the auxiliary top drive 16 so as to provide a conduit for the supply of a pressurized working fluid to the pump system 34. Pressurized working fluid from the drilling rig 12, such as from the rig's mud pumps, is pumped through the top drive 16 and into the drive string 36. A fluid motor 50, such as a progressive cavity pump, is coupled to the drive string 36 and is rotated by the flow of pressurized working fluid provided by the drive string 36. The fluid motor 50 is coupled to and operates the pump system 34. In this embodiment, the drive string 36 can be held stationary or can be rotated to provide additional torque to the pump system 34.

In FIG. 5, the drive string 36 is coupled to rotary table, or gear box, 52 that is mounted on the drill floor and rotates the drive string. The rotary table 52 may be coupled to the drilling rig's power generation system or may include its own integrated power system. This system does not require the use of the auxiliary top drive 16 to operate the pump system 34.

Figure 6:
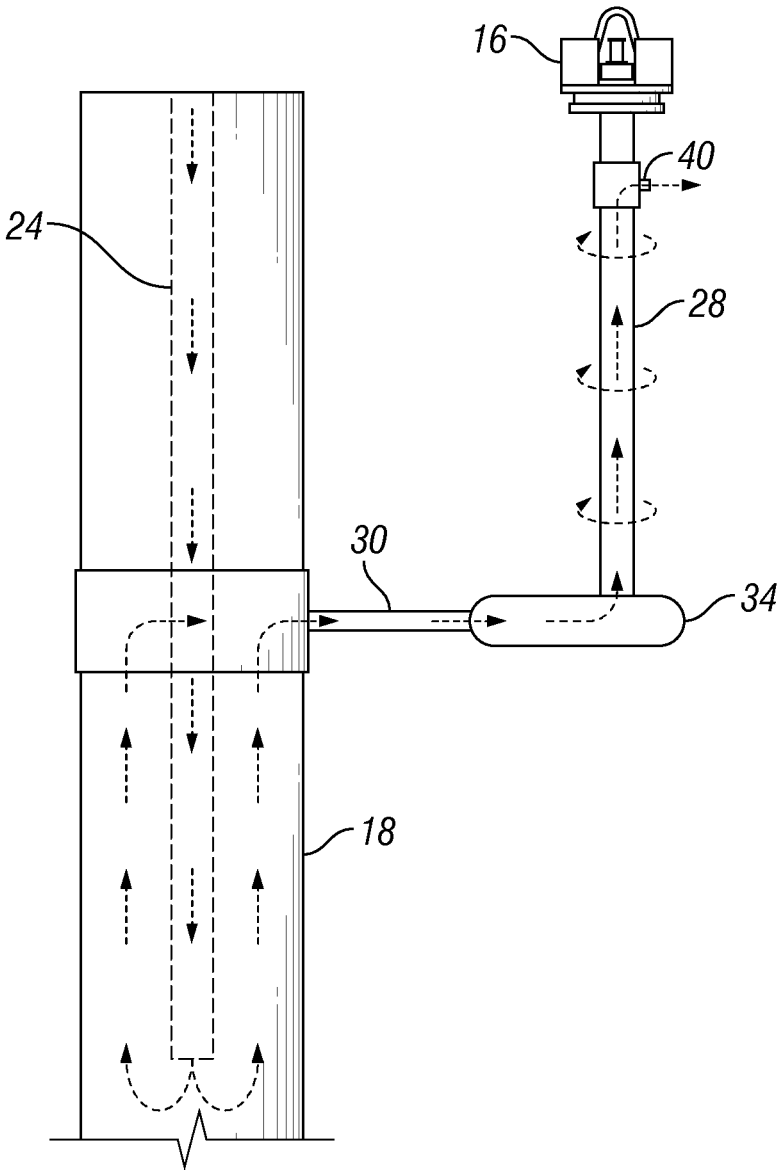
FIG. 6 is a partial schematic view of a dual gradient drilling system where drilling fluid is returned to the drilling rig through the auxiliary riser.
Figure 7:
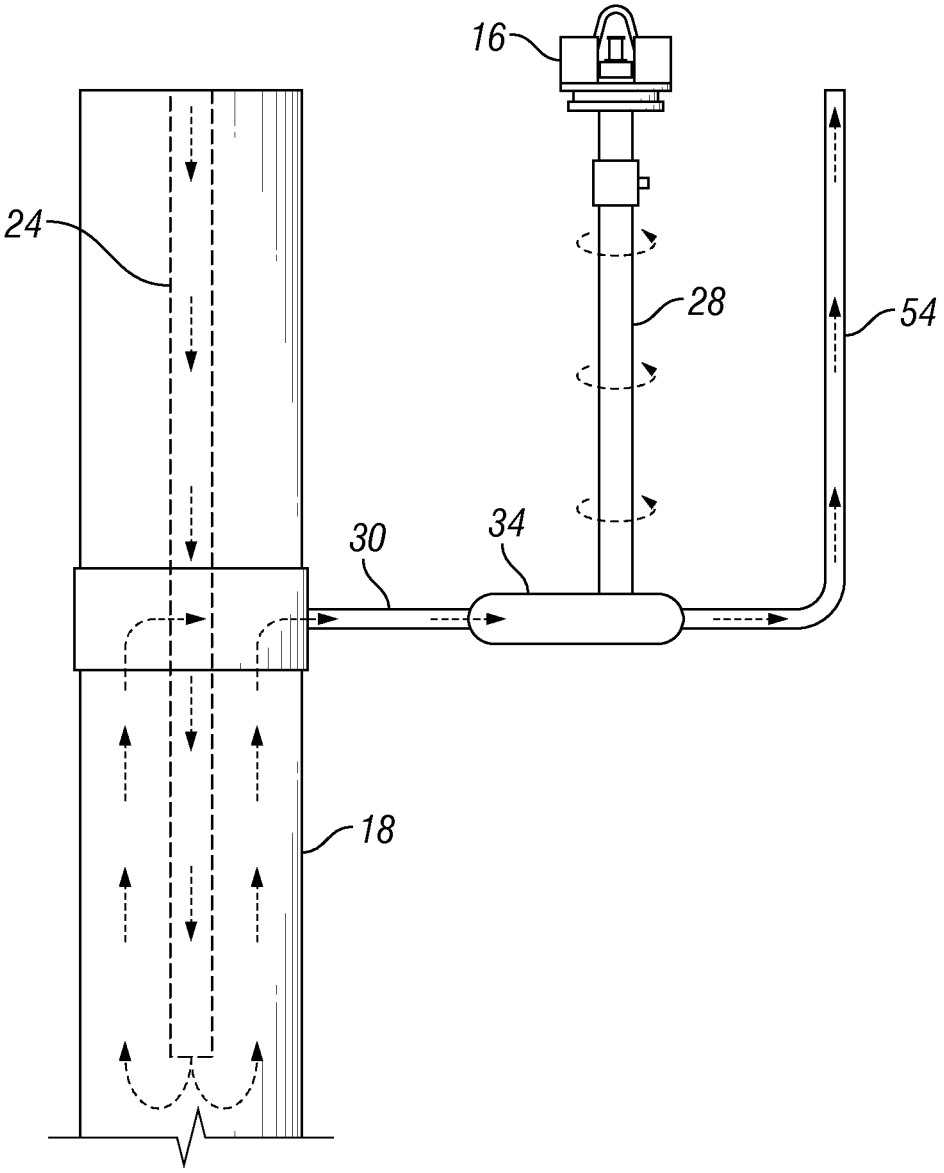
FIG. 7 is a partial schematic view of a dual gradient drilling system where drilling fluid is returned to the drilling rig through an auxiliary line.

Systems such as those described herein can be used to support a variety of different systems for handing the drilling fluid removed from the primary riser 18. For example, in reference to FIG. 6, pump system 34 removes drilling fluid from the primary riser 18 via fluid conduit 30. The drilling fluid is then returned to the drilling rig 12 via the auxiliary riser 28 where it passes through fluid outlet 40 to be processed by the rig's fluid processing equipment. In this embodiment, the portion of the primary riser 18 above the fluid conduit 30 is primarily evacuated of drilling fluid, thereby decreasing the hydrostatic pressures generated in the well. In an alternative embodiment, as shown in FIG. 7, the pump system 34 returns drilling fluid to the drilling rig 12 via an auxiliary return line 54 that can be separate from the auxiliary riser 28.

Figure 8:
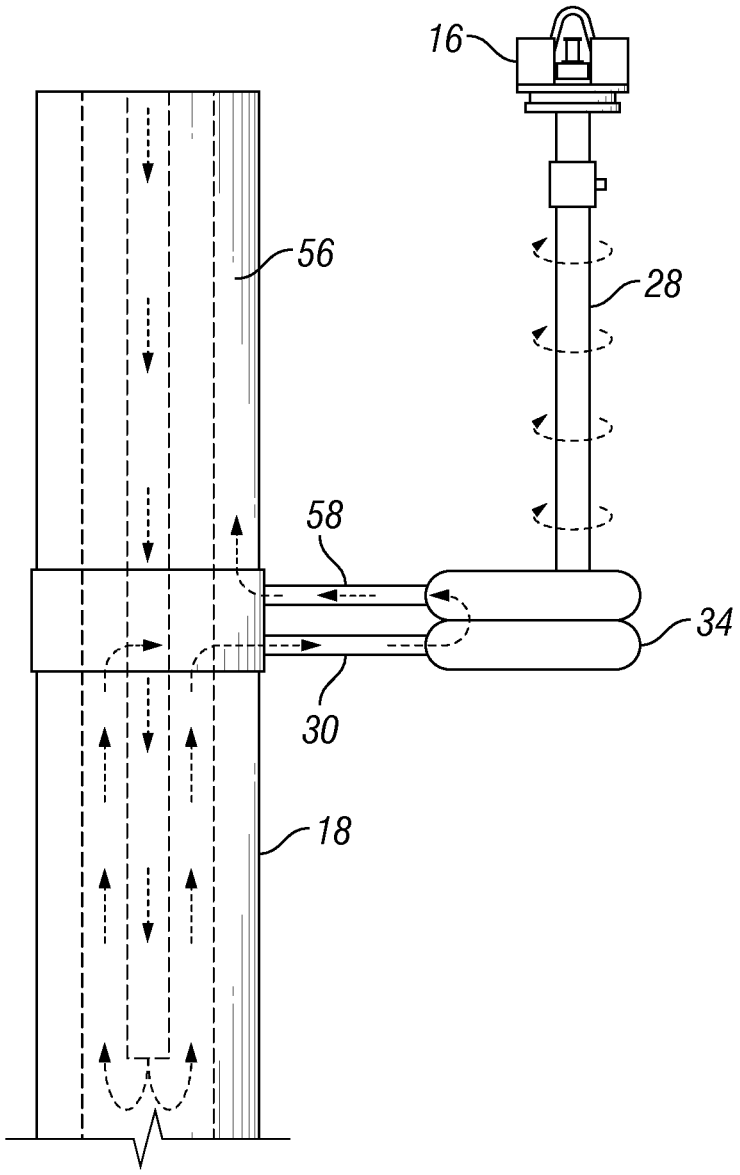
FIG. 8 is a partial schematic view of a dual gradient drilling system where drilling fluid is returned to the drilling rig through a concentric riser.

Referring now to FIG. 8, pump system 34 returns drilling fluid to the drilling rig 12 via a concentric riser 56 that is disposed within the primary riser 18 but isolated from the wellbore. The pump system 34 draws fluid from the primary riser 18 through fluid conduit 30 and then returns fluid to the concentric riser 56 through return conduit 58. The upper end of the concentric riser 56 can be coupled to the rig's fluid processing equipment.

Although the systems described herein are illustrated as being used to remove a portion of the drilling fluid from the primary riser 18, similar systems could also be used to pump a low density fluid into the primary riser. Pumping a low density fluid into the primary riser 18 can also be used to decrease the hydrostatic pressure in the wellbore by decreasing the effective density of the column of drilling fluid.

While the disclosure is susceptible to various modifications and alternative forms, specific embodiments thereof are shown by way of example in the drawings and description. It should be understood, however, that the drawings and detailed description thereto are not intended to limit the disclosure to the particular form disclosed, but on the contrary, the intention is to cover all modifications, equivalents and alternatives falling within the spirit and scope of the present disclosure.

What is claimed is:

1. A dual gradient drilling system comprising:

a dual activity drilling rig having a primary and a secondary hoist systems;

a primary riser coupled to the dual activity drilling rig and a blowout preventer mounted to a subsea wellhead;

an auxiliary riser coupled to the dual activity drilling rig and to the primary riser by a fluid conduit that is disposed at a point along the primary riser above the blowout preventer, wherein the fluid conduit provides fluid communication between the primary riser and the auxiliary riser;

a pump system disposed within the auxiliary riser and in fluid communication with the fluid conduit; and a drive string disposed within the auxiliary riser and coupled to the pump system, where the drive string operably couples the pump system to the dual activity drilling rig.

2. The dual gradient drilling system of claim 1, wherein the drive string is rotatably coupled to the pump system so that rotation of the drive string operates the pump system.

3. The dual gradient drilling system of claim 2, wherein the drive string is rotated by a top drive mounted on the dual activity drilling rig.

4. The dual gradient drilling system of claim 1, wherein the drive string provides a conduit for the supply of a pressurized working fluid from the dual activity drilling rig to a fluid motor of the pump system.

5. The dual gradient drilling system of claim 1, wherein the pump system returns a drilling fluid from the primary riser to the dual activity drilling rig through the auxiliary riser.

6. The dual gradient drilling system of claim 1, wherein the pump system returns a drilling fluid from the primary riser to the dual activity drilling rig through an auxiliary return line.

7. The dual gradient drilling system of claim 1, wherein the pump system returns a drilling fluid from the primary riser to the dual activity drilling rig through a concentric riser that is disposed within the primary riser.

8. The dual gradient drilling system of claim 1, further comprising a linkage that is coupled to the primary riser and the auxiliary riser to maintain an axial offset between the primary riser and the auxiliary riser.

9. A dual gradient drilling system comprising:

a dual activity drilling rig;

a primary riser providing fluid communication between the dual activity drilling rig and a subsea wellbore;

a drilling string suspended through the primary riser;

an auxiliary riser providing fluid communication between the dual activity drilling rig and the primary riser at a depth between the drilling rig and the subsea wellbore; and a pump system disposed within the auxiliary riser and operably coupled to the dual activity drilling rig by a drive string suspended through the auxiliary riser, wherein the pump system is operable to remove drilling fluid from the primary riser.

10. The dual gradient drilling system of claim 9, wherein the drive string is rotatably coupled to the pump system so that rotation of the drive string operates the pump system.

11. The dual gradient drilling system of claim 9, wherein the drive string provides a conduit for the supply of a pressurized working fluid from the dual activity drilling rig to a fluid motor of the pump system.

12. The dual gradient drilling system of claim 9, wherein the pump system returns a drilling fluid from the primary riser to the dual activity drilling rig through the auxiliary riser.

13. The dual gradient drilling system of claim 9, wherein the pump system returns a drilling fluid from the primary riser to the dual activity drilling rig through an auxiliary return line.

14. The dual gradient drilling system of claim 9, wherein the pump system returns a drilling fluid from the primary riser to the dual activity drilling rig through a concentric riser that is disposed within the primary riser.

15. The dual gradient drilling system of claim 1, further comprising a linkage that is coupled to the primary riser and the auxiliary riser to maintain an axial offset between the primary riser and the auxiliary riser.

16. A method comprising:

coupling a primary riser to a dual activity drilling rig and a blowout preventer mounted to a subsea wellhead;

suspending a drill string through the primary riser;

coupling an auxiliary riser to the dual activity drilling rig;

coupling the auxiliary riser to the primary riser at a location between the dual activity drilling rig and the subsea wellhead with a fluid conduit;

coupling a pump system to the auxiliary riser and to the fluid conduit; and operating the pump system with a drive string suspended from the dual activity drilling rig and through the auxiliary riser to remove a drilling fluid from the primary riser through the fluid conduit and into the pump system.

17. The method of claim 16, further comprising pumping the drilling fluid from the pump system to the dual activity drilling rig through the auxiliary riser.

18. The method of claim 16, further comprising pumping the drilling fluid from the pump system to the dual activity drilling rig through a concentric riser that is disposed within the primary riser.

19. The method of claim 16, wherein the pump system is operated by rotating a drive string that is coupled to the pump system and to the dual activity drilling rig, wherein the drive string is disposed within the auxiliary riser.

20. The method of claim 16, wherein the pump system is operated by pumping a working fluid through a drive string that is coupled to the pump system and to the dual activity drilling rig, wherein the drive string is disposed within the auxiliary riser.

* * * * *